US005085475A

United States Patent [19]

Austin et al.

[11] Patent Number: 5,085,475

[45] Date of Patent: Feb. 4, 1992

[54] EXIT-DELAYING MECHANISM, FOR A PANIC EXIT DEVICE

[75] Inventors: Marlin Austin, Speedway; Michael Cain, Noblesville; Paul J. Haeck, Carmel, all of Ind.

[73] Assignee: Von Duprin, Inc., Indianapolis, Ind.

[21] Appl. No.: 709,167

[22] Filed: Jun. 3, 1991

[51] Int. Cl.[5] ..... E05C 3/08

[52] U.S. Cl. ..... 292/92; 292/336.3; 292/144; 292/153

[58] Field of Search ..... 292/21, 92, 144, 153, 292/150, 169.13

[56] References Cited

U.S. PATENT DOCUMENTS 2,343,249 3/1944 Spinello ..... 292/153 X 3,614,145 10/1971 Zawadzki ..... 292/92

5,011,199 4/1991 Lowe et al. ..... 292/92

*Primary Examiner*—Richard E. Moore

*Attorney, Agent, or Firm*—Walter C. Vliet; Bernard J. Murphy

[57] ABSTRACT

A housing mounted to the frame of a panic exit device confines a translatable limb, and a pivotable arm. The limb has a lobe which obstructs the arm to prevent its pivoting and, as a consequence, the arm blocks the latchbolt linkage of the device to prevent unlatching. A rod joined to a time-delayed-operative solenoid is coupled to the limb for displacing the limb from arm-pivoting obstruction, to allow the arm to unblock the latchbolt linkage, whereby the latchbolt can unlatch following the time delayed deenergization of the solenoid. Under normal conditions, the solenoid is energized to prohibit immediate unlatching.

9 Claims, 3 Drawing Sheets

EXIT-DELAYING MECHANISM, FOR A PANIC EXIT DEVICE

This application sets forth an exit-delaying mechanism, for a panic exit device, which is similar to such mechanisms disclosed in U.S. Patent application Ser. No. 07/458,194, filed on Dec. 28, 1989, by Peter Lowe, et.al., for a Panic Exit Device having an Exit-Delaying Mechanism, now U.S. Pat. No. 5,011,199, issued Apr. 30, 1991 and assigned to the assignee of the present invention. Said U.S. Pat. No. 5,011,199 is hereby incorporated by reference for supplemental explanation of panic exit devices in general, as well as background from similar exit-delaying mechanisms therein.

BACKGROUND OF THE INVENTION

This invention relates generally to door hardware, and more particularly to panic exit devices. Such devices have a push bar substantially spanning the width of the door, or the like, to which it is mounted, for movement toward the door and translation or other actuation of linkage in order to retract a latchbolt. Such devices are characterized as of panic types, in that they immediately release the latchbolt and provide rapid egress. There are circumstances, however, in which an immediate and rapid egress is not desirable.

In hospitals and/or nursing homes, there need to be secure exits which will afford exiting but, also, will briefly delay such just long enough so that responsible attendants can ascertain the competence of those using the exit. If ill or disoriented persons operate a panic exit device, and can be delayed long enough for an alarm to be sounded, they can be prevented from putting themselves in harm's way.

In the aforecited patent application, a number of embodiments of panic exit devices with exit-delaying mechanisms are disclosed, the same including alarm-sounding features. It is a purpose of this invention to set forth an exit-delaying mechanism of greatly simplified construction, for incorporation in a panic exit device, and especially such a mechanism which is subject to a minimum of frictional resistance in the operation thereof. In reducing the frictional resistance, the mechanism provides higher holding forces, and requires lower release forces.

SUMMARY OF THE INVENTION

In one aspect of the present invention the aforesaid purpose is accomplished by providing, for a panic exit device which has a frame, a latchbolt mounted to said frame for movement relative to said frame between a first, latched position, and a second, unlatched position, and a manually-actuated linkage joined to said latchbolt and movably mounted to said frame for moving said latchbolt from said first position to said second position, exit-delaying mechanism for said device, comprising first means pivotably and translatably mounted to said frame and operative (a) in a first mode for obstructing, and (b) in a second mode for permitting movement of said linkage from said first position to said second position; and second means coupled to said frame and to said first means operative, in response to, and with a specific time delay following, manual actuation of said linkage, for changing said first means from said first operative mode to said second operative mode thereof.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
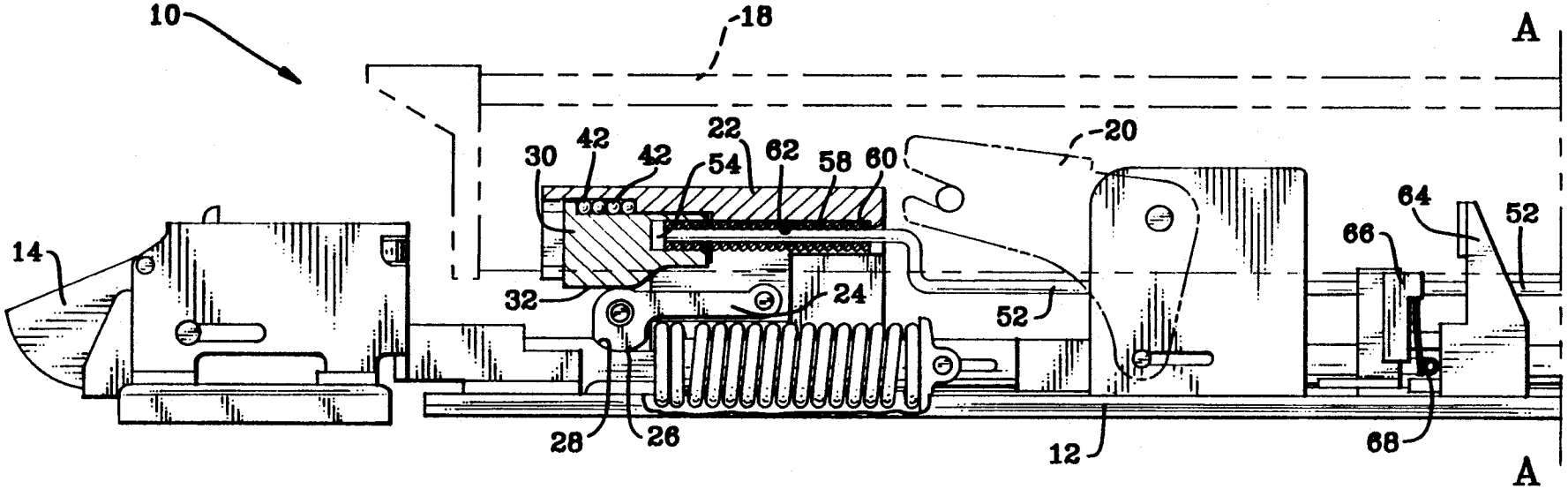
FIG. 1 is a side elevational view of a panic-exit device, with the push bar and cranks shown only in phantom, which has an embodiment of the invention incorporated therein, and the solenoid energized to prohibit unlatching of the latchbolt.
Figure 1A:
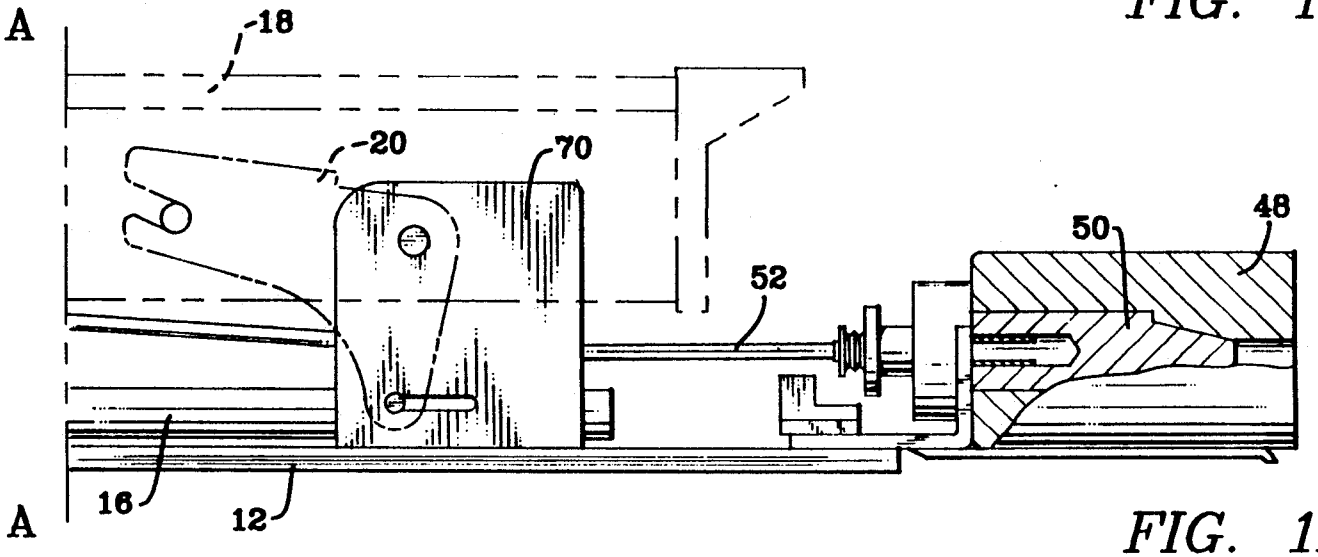
FIG. 1A is a continuation of FIG. 1 from Section Line A—A.
Figure 2:
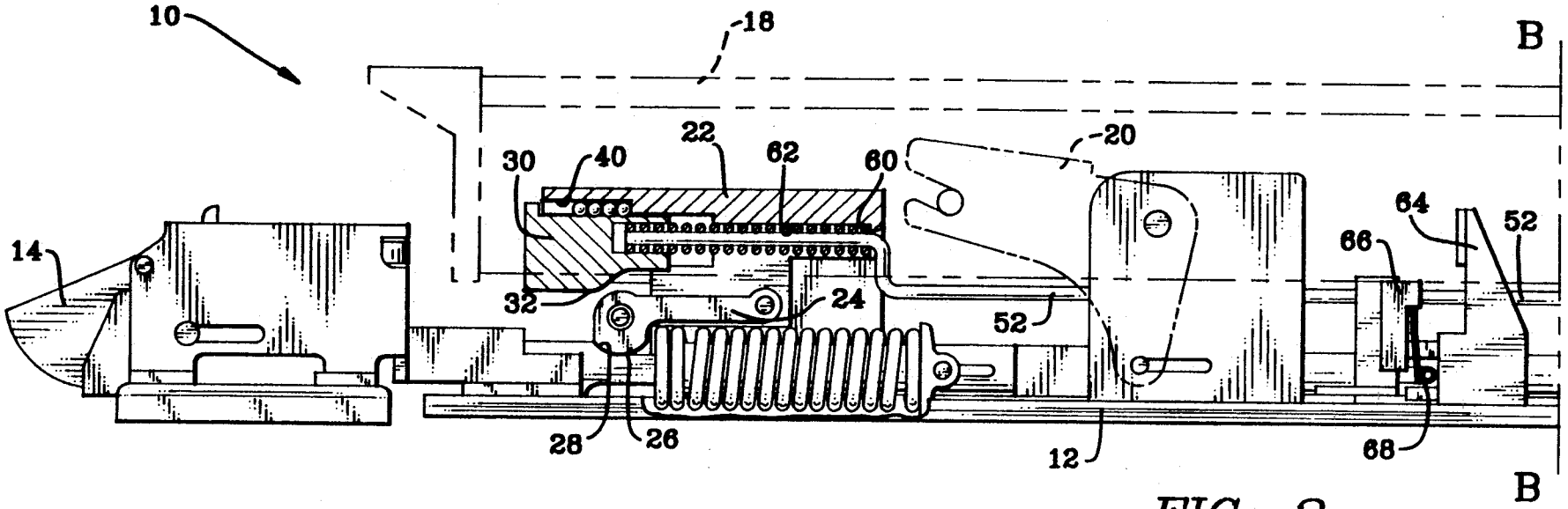
FIG. 2 is a view similar to that of FIG. 1 wherein, however, the solenoid is deenergized to permit unlatching of the latchbolt.
Figure 2A:
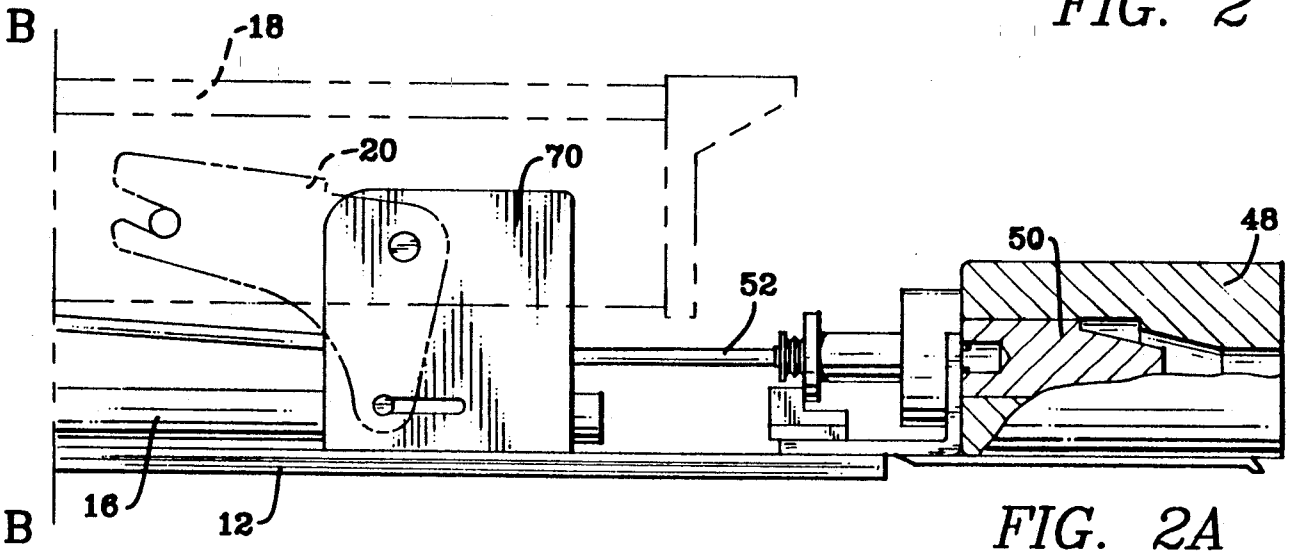
FIG. 2A is a continuation of FIG. 2 from Section Line B—B.

For purposes of cross-reference, FIGS. 1 and 2 are generally similar to FIGS. 20 and 22 of the aforecited U.S. Pat. No. 5,011,199. A panic-exit device 10 comprises a frame 12, a latchbolt 14 pivotably mounted to the frame 12, and a linkage 16 slidably attached to the frame 12 and coupled to the latchbolt 14. A push bar 18, which rotates cranks 20, translates the linkage 16 to cause the latchbolt 14 to retract.

Figure 6:
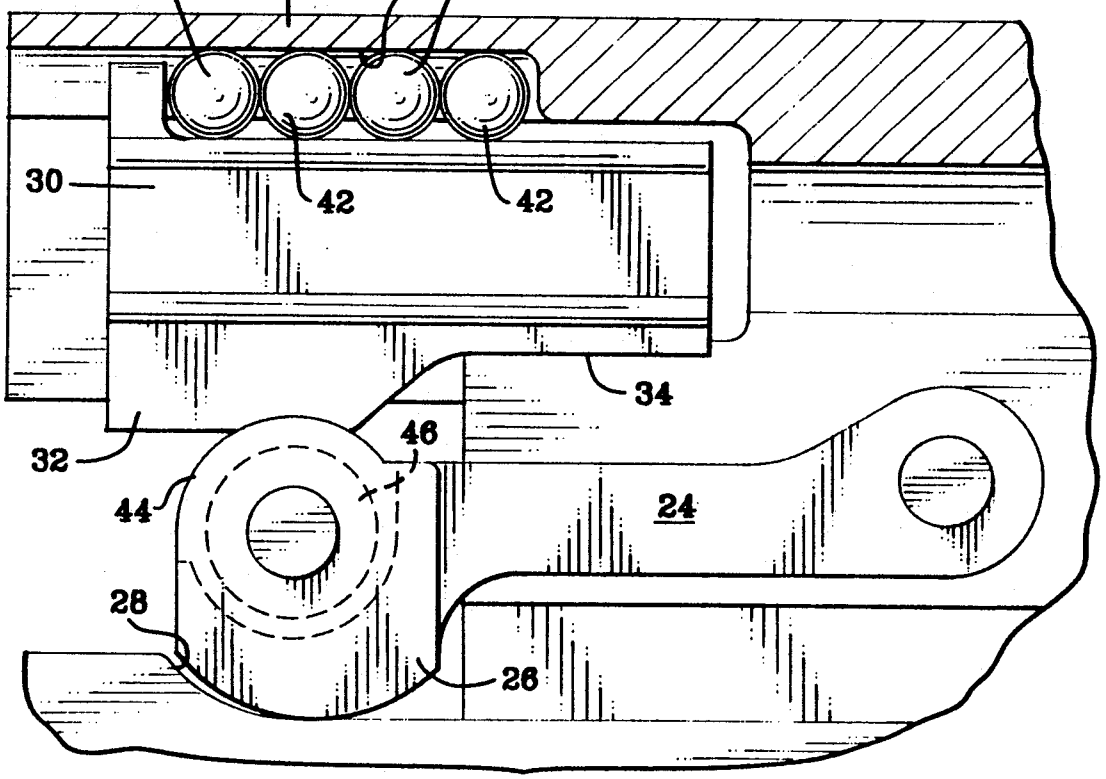
FIG. 6 is a greatly enlarged illustration of the translatable limb and the pivotable arm, in relation to the linkage, the internal configuration of the limb not being shown here.
Figure 3:
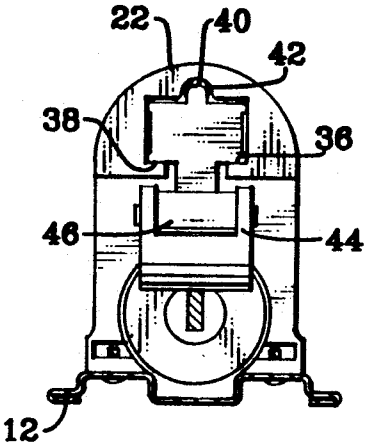
FIG. 3 is an end view of the exit-delaying mechanism housing, the same showing the pivotable arm in linkage-blocking disposition.
Figure 4:
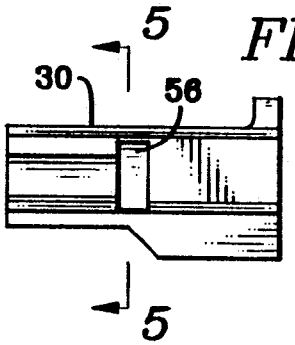
FIGS. 4 and 5 are side elevational and cross-sectional views of the exit-delaying, translatable limb, respectively, the cross-section being taken along section 5—5 of FIG. 4.
Figure 5:
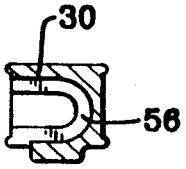

To the device 10 has been added the subject exit-delaying mechanism, and the latter comprises a housing 22 which is fastened to the frame 12. Pivotably mounted to the housing 22 is an arm 24 which has an underslung protuberance 26 of arcuate form. The linkage 16 has a ramp 28 formed therein which, as shown in FIGS. 1 and 6, confronts the protuberance 26. With translation of the linkage 16 to the right (as viewed in FIG. 1), the protuberance 26 rides up the ramp 28, pivoting the arm 24 up into the housing 22, if the arm 24 is not blocked against pivotable movement into the housing. In the housing 22, however, as shown in FIG. 1, there is an element which blocks the arm 24. A translatable limb 30 is confined within the housing 22. The limb 30 has an underslung lobe 32 and a recess 34, the former being provided to block pivotable movement of the arm 24, and the latter being provided to accommodate movement of the arm thereinto.

The housing 22 has a trackway 36 formed therein, and the limb 30 has parallel rails 38 which slidably engage the trackway. In addition, in the uppermost portion of the housing 22 is a narrow channel 40. The channel 40 confines therein a plurality of bearing balls 42. As the balls 42 are interposed between the limb 30 and the closed top of the housing 22, they facilitate a low friction translation of the limb 30. Too, the arm 24 has a bifurcation 44 in which is journalled a roller 46. Lobe 32 of limb 30 rides upon the roller 46 as a means of providing for further low friction movement of the limb 30.

A solenoid 48 is fastened to the frame 12, and it has an inductively movable bar 50 which has one end of a rod 52 coupled thereto. The opposite end of the rod 52 has a small head 54 integral therewith. The head 54 is captive in an enlarged recess 56 formed in the limb 30. A compression spring 58 is set against the head 54 at one end, and against a shoulder 60 formed in a bore 62 of the housing 22 through which the rod 52 is accommodated.

With the solenoid energized, as represented in FIG. 1, lobe 32 of the limb 30 has the arm 24 blocked. Arm 24 cannot pivot to allow its protuberance 26 to ride up the ramp 28 and, as a consequence thereof, the linkage 16 cannot translate to retract the latchbolt 14. With deenergization of the solenoid 48, as represented in FIG. 2, the bar 50 has withdrawn from the coil of the solenoid, and moved the rod 52 to the left (as viewed in FIG. 2). Consequently, the limb 30 has also moved to the left, and withdrawn its lobe 32 from obstruction of the arm 24. Now, if the push bar 18 is pushed, the cranks 20 will translate the linkage 16 to the right, the arm will ride up the ramp 28, freeing the linkage for full translation, and the latchbolt 14 retracts.

The invention comprehends a time delay logic feature, as disclosed in the aforecited U.S. Pat. No. 5,011,199, which is not detailed herein. Simply, the referenced logic, operating from a source of power, responds to the closure of a switch to institute a predetermined delay before deenergizing the solenoid 48. Too, the circuitry comprehends the activation of lights and/or a horn. In this regard, linkage 16 has an abutment 64 mounted thereon, for purposes not germane to the instant invention, which translates with the linkage 16. A time-delay switch 66 (corresponding to switch 46 of the referenced application) is fixed to the frame 12. It has a leaf spring 68 which displaces as soon as the linkage makes an initial movement to activate the time-delay logic. Panic exit device have a built-in, lost-motion feature which, in spite of the blockage of the linkage 16 by the arm 24, accommodates a short translation of the linkage 16. This is sufficient for the switch 66 to respond to such slight movement of the abutment 64 against which the leaf spring 68 is constrained to commence the time delay for deenergization of the solenoid 48.

As noted, the time delay can be predetermined. If it is chosen to be fifteen seconds, the lapse of that time will find the solenoid deenergizing to translate the rod 52. As explained, this removes the limb 30 and its lobe 32 from obstruction of the arm 24. The latter pivots out of the way of the linkage 16, by its protuberance 26 riding up the ramp 28. The linkage 16 moves to the right, and withdraws the latchbolt 14 from its strike (not shown). The priorly mentioned spring 58 assists in moving the rod 52 coincident with the deenergization of the solenoid 48. Too, a compression spring (not shown) which is interposed between abutment 64 and a bracket 70, which pivotably mounts one of the cranks 20, returns the linkage 16 to the left, and in turn the latchbolt 14 is extended again for engagement with its strike. Such spring-return of linkage is a well known practice in panic exit devices, and is believed to require no detailed explanation here.

While we have described our invention in connection with a specific embodiment thereof, it is to be clearly understood that this is done only by way of example and not as a limitation to the scope of the invention as set forth in the appended claims.

Having described the invention, what is claimed is:

1. For a panic exit device which has a frame, a latchbolt mounted to said frame for movement, relative to said frame, in a first direction, between a first, latched position, and a second, unlatched position, and a manually-actuated linkage joined to said latchbolt and mounted to said frame for movement in said first direction to effect displacement of said latchbolt from said first position to said second position, exit-delaying mechanism for said device, comprising:

first means pivotably and translatably mounted to said frame and operative (a) in a first mode for obstructing, and (b) in a second mode for permitting movement of said linkage, to allow linkage-displacement of said latchbolt from said first position to said second position; and second means coupled to said frame and to said first means operative, in response to, and with a specific time delay following, manual actuation of said linkage, for changing said first means from said first operative mode to said second operative mode thereof; wherein said first means comprises linkage-movement blocking means movable in said first direction, and a second, opposite direction, and having means, responsive to movement of said blocking means in said second direction, for permitting movement of said linkage.

2. Exit-delaying mechanism, for a panic exit device, according to claim 1, wherein said first means comprises a housing fixed to said frame in adjacency to said linkage, an arm pivotably journalled in said housing, and a limb translatable in said housing; and said linkage has means for engaging said arm and causing pivotable movement of said arm.

3. For a panic exit device which has a frame, a latchbolt mounted to said frame for movement, relative to said frame, in a first direction, between a first, latched position, and a second, unlatched position, and a manually-actuated linkage joined to said latchbolt and movably mounted to said frame for moving said latchbolt from said first position to said second position, exit-delaying mechanism for said device, comprising:

first means pivotably and translatably mounted to said frame and operative (a) in a first mode for obstructing, and (b) in a second mode for permitting movement of said linkage, to allow linkage-displacement of said latchbolt from said first position to said second position; and second means coupled to said frame and to said first means operative, in response to, and with a specific time delay following, manual actuation of said linkage, for changing said first means from said first operative mode to said second operative mode thereof; wherein said first means comprises a housing fixed to said frame in adjacency to said linkage, an arm pivotably journalled in said housing, and a limb translatable in said housing;

said linkage has means for engaging said arm and causing pivotable movement of said arm;

said housing has a trackway formed therein; and said limb has rails formed thereon which slidably engage said trackway; and further including rolling elements interposed between said limb and said housing facilitating low friction movement of said limb, translatably, in said housing.

4. Exit-delaying mechanism, for a panic exit device, according to claim 3, wherein said arm-engaging means of said linkage comprises a ramp.

5. Exit-delaying mechanism, for a panic exit device, according to claim 3, wherein said limb surmounts said arm, and has a lobe for blocking pivotable movement of said arm and a recess for accommodating pivotable movement of said arm thereinto.

6. Exit-delaying mechanism, for a panic exit device, according to claim 5, wherein said limb is translatable in said housing, as aforesaid, between a first attitude in which said lobe blocks said arm, and a second attitude in which said lobe unblocks said arm and said recess is disposed for movement of said arm thereinto; and said second means comprises means for moving said limb between said first and second attitudes thereof.

7. Exit-delaying mechanism, for a panic exit device, according to claim 5, wherein said arm has a roller journalled therein for engagement with said limb to facilitate low friction movement of said limb in said housing.

8. Exit-delaying mechanism, for a panic exit device, according to claim 6, wherein said limb moving means comprises a solenoid.

9. Exit-delaying mechanism, for a panic exit device, according to claim 8, wherein said solenoid has a bar inductively movable therein; and further including a rod, coupled at one end to said bar, and coupled at the opposite end thereof to said limb.

* * * * *